United States Patent [19]

Grocott

[11] Patent Number: 4,596,100

[45] Date of Patent: Jun. 24, 1986

[54] BUILDING CONSTRUCTION

[76] Inventor: Rodney B. Grocott, 3 Barrier St., Fyshwick, ACT. 2609, Australia

[21] Appl. No.: 499,800

[22] PCT Filed: Aug. 26, 1982

[86] PCT No.: PCT/AU82/00142

§ 371 Date: Apr. 21, 1983

§ 102(e) Date: Apr. 21, 1983

[87] PCT Pub. No.: WO83/00716

PCT Pub. Date: Mar. 3, 1983

[30] Foreign Application Priority Data

Aug. 26, 1981 [AU] Australia ..... PF0407

[51] Int. Cl.[4] ..... E04H 3/00

[52] U.S. Cl. ..... 52/241; 52/586; 52/591; 52/721; 52/745

[58] Field of Search ..... 52/90, 745, 238.1, 721, 52/155, 241, 586, 591, 593, 284; 446/125

[56] References Cited

U.S. PATENT DOCUMENTS

| | | | |
|---|---|---|---|
| 1,693,742 | 12/1928 | Bemis | 52/238.1 X |
| 3,292,328 | 12/1966 | Lewis et al. | 52/238.1 |
| 3,821,868 | 7/1974 | Edwards | 42/241 |
| 4,018,020 | 4/1977 | Sauer et al. | 52/241 |
| 4,028,855 | 6/1977 | Prewer | 52/238.1 X |
| 4,035,977 | 7/1977 | Fischer | 52/586 |
| 4,071,990 | 2/1978 | Traber | 52/155 |

FOREIGN PATENT DOCUMENTS

| | | | |
|---|---|---|---|
| 836805 | 3/1970 | Canada | 52/90 |
| 2651777 | 11/1976 | Fed. Rep. of Germany | 52/586 |
| 219263 | 2/1968 | Sweden | 52/90 |
| 806242 | 12/1958 | United Kingdom | 52/721 |
| 1350942 | 4/1974 | United Kingdom | 52/586 |

*Primary Examiner*—Carl D. Friedman
*Assistant Examiner*—Naoko N. Slack
*Attorney, Agent, or Firm*—Kane, Dalsimer, Kane, Sullivan and Kurucz

[57] ABSTRACT

A method of modular construction of buildings and novel support members for use in such construction utilizing metal base members (2) which are first affixed to a floor or foundation (1) then a series of metal uprights (20) are affixed to said base members by u-shaped connecting member (16). In-fill panels (9) are fixed between said uprights and said base members. A metal flashing (6) is attached to said base member. A channel member (25) connects the top of the said uprights giving support to the building against sideways movement. The said in-fill panels also assist in preventing sideways movement by reason of their spigot-type attachment to said uprights and said base member. The novel support members of the present invention are the channel member (25) and the in-fill panel (9).

3 Claims, 6 Drawing Figures

A
A
1
2
5
16
17
18
19
20
21
22
23
24
25
26
27
28
29

BUILDING CONSTRUCTION

This invention relates to an improved manner of construction of houses or other buildings and has for its object to provide means whereby buildings can be erected in a simple and rapid manner upon a modular system, the various components being readily prefabricated and later assembled on site. There is disclosed in Australian Pat. No. 412,335 the use of a modular system of construction comprising mounting a series of metal uprights upon a prepared base, each of said uprights being provided towards its lower end with horizontal projections which, together with the upright are in the general form of an inverted "T", said upright also being provided with separate means located below the horizontal projections to affix the upright to the base, said horizontal projections being supported by the base, subsequently introducing infill panels between the uprights and securing reef beams (or transoms) across the upper ends of such uprights.

Prior Australian Pat. No. 499,349 discloses an improved method of modular construction and a support member for use in such method comprising an upright comprising an elongate member, said member being provided with at least one longitudinally extending slot or groove, a stake member adapted to engage said slot or groove and project horizontally therefrom, said stake member being positioned towards the lower end of said upright and extending into and engaging the end of a horizontally disposed cross piece of tubular metal construction, said stake member being a generally U-shaped member having a base and a pair of spaced, generally parallel arms extending from said base, said base being provided with means to engage said slot or groove in said elongate member and each said arm being provided with means to engage the internal surface of said cross piece.

The above disclosed methods of construction suffer from a major disadvantage in that it is almost impossible to position and secure exactly the elongate member in the foundation such that it is aligned vertically, within allowable tolerance limits.

Both the known systems of modular constructions all suffer from one or more major disadvantages. Load-bearing walls are difficult to incorporate in such systems, also some systems cannot be adapted to accomodate a change in design either during construction stages or after completion as an addition to the existing structure. The lack of strength of some modular homes or buildings makes them unsuitable for use in regions of high wind. Some modular systems are of such complexity as to require skilled workmen to erect them.

One problem that has to be overcome with any building and in particular with one of modular construction is that of water penetration and a number of methods are presently in use to overcome this problem.

It is an object of the present invention to provide an improved method of modular construction which substantially alleviates the above disadvantages.

According to the present invention there is provided a method of modular construction of a house, or other building comprising the steps of:

(a) affixing to a floor or foundation a series of metal base members, said base members having at least one lengthwise extending slot or groove, (b) affixing to said base members a series of metal uprights said uprights having at least one lengthwise extending slot or groove on at least two opposing outer faces, a "U" shaped connecting member having a base and two substantially parallel arms extending from said base, said arms adapted to slideably engage said slots on opposing outer faces of said upright and said base adapted to stand proud of the end of said upright and engage a slot in said base members, (c) attaching panels between said uprights and base member, said panels having gasket seal to engage a portion of said base member and said uprights respectively and thereby form weather proof joints;

(d) attaching a metal flashing to base members, (e) affixing to the top of the uprights a series of metal channel members having one lengthwise extending groove, (f) securing known roof trusses across the top of said channel members.

Further features of the present invention will be apparent from the following description of one preferred embodiment as illustrated in the accompanying drawings.

In these:

The present invention can be used with either wooden floors or concrete foundations and it is a simple matter to correct any uneveness in the floor or foundation by inserting pieces of metal under the base member.

Figure 2:
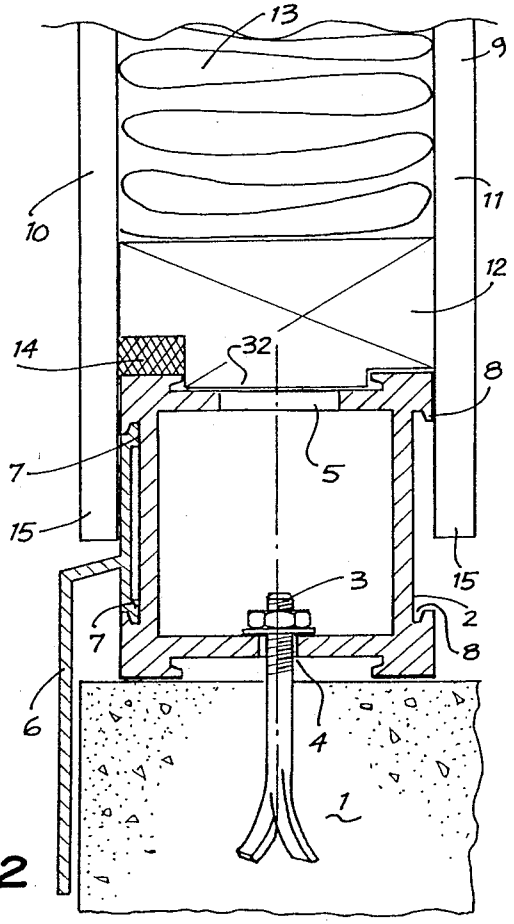
FIG. 2 is a sectional elevation view of showing the base member attached to the foundation and supporting a protective flashing.
Figure 1:
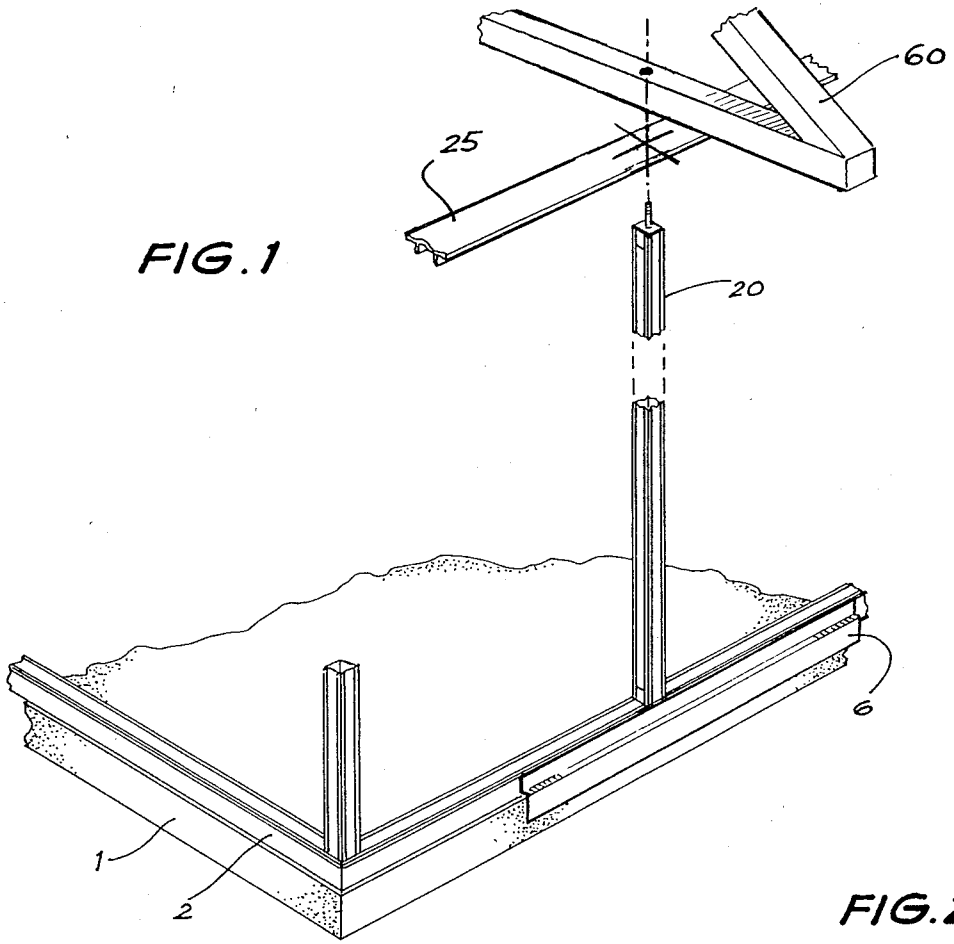
FIG. 1 is a schematic view of one corner of a building under construction with a known roof truss.

In FIGS. 1 and 2, there is shown a foundation 1 around the periphery of which is placed a base member 2. The base member 2 is also used for supporting internal walls (not shown). The base member 2 is attached to the foundation preferably by means of a bolt 3 which fastens through holes 4 and 5 in base member 2. Hole 5 being an access hole is of a larger diameter than hole 4 thereby allowing the bolt to be secured inside base member 2.

Alternatively when the floor 1 is of timber, the base member 2 can be affixed by screw means.

As a further alternative, for use in cyclone areas a sleeve member 23 (in FIG. 4) is first cemented into foundation 1 and base member 2 affixed thereto by means of bolt 3.

For protections against the weather a flashing 6 is adapted by end means 7 to slideably engage slots 8 in base member 2.

Figure 6:
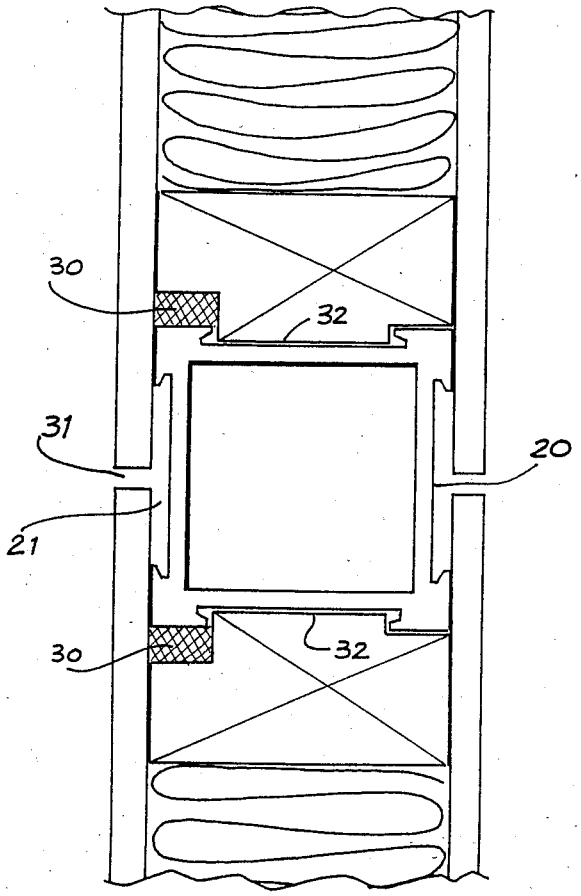
FIG. 6 is a sectional plan view showing the panels connected sprigot fashion onto an upright and showing the gasket seal.

A panel 9 has a recess 13 infilled with rockwool or other suitable material, and sides 10 and 11 which have extending portions 15 at the bottom and vertical sides to overlap respectively a portion of the base member 2 (shown in FIG. 2) and in the upright 20 (shown in FIG. 6).

Around the inside of panel 9 there is a wooden spacing member 12 whose lower edge 32 is adapted to engage in a spigot fashion the slots 8 respectively in the base member 2 (shown in FIG. 2) and in the upright 20 (shown in FIG. 6).

The panel 9 is non load-bearing, the roof being entirely supported by the uprights thereby permitting changes in design at any stage of construction.

In FIG. 2 can be seen the gasket seal 14 which self expands and holds against a portion of base member 2 thereby forming a weather proof joint.

In FIG. 6 the gasket seals 30 are compressed against a portion of the upright 20 thereby forming a weatherproof joint. The spacing 31 between panels can be filled or left exposed as a design feature, because any water that enters spacing 31 would run down slot 8 in upright 20 and be carried away from the bottom of the building by flashing 6.

Figures 3, 4, 5:
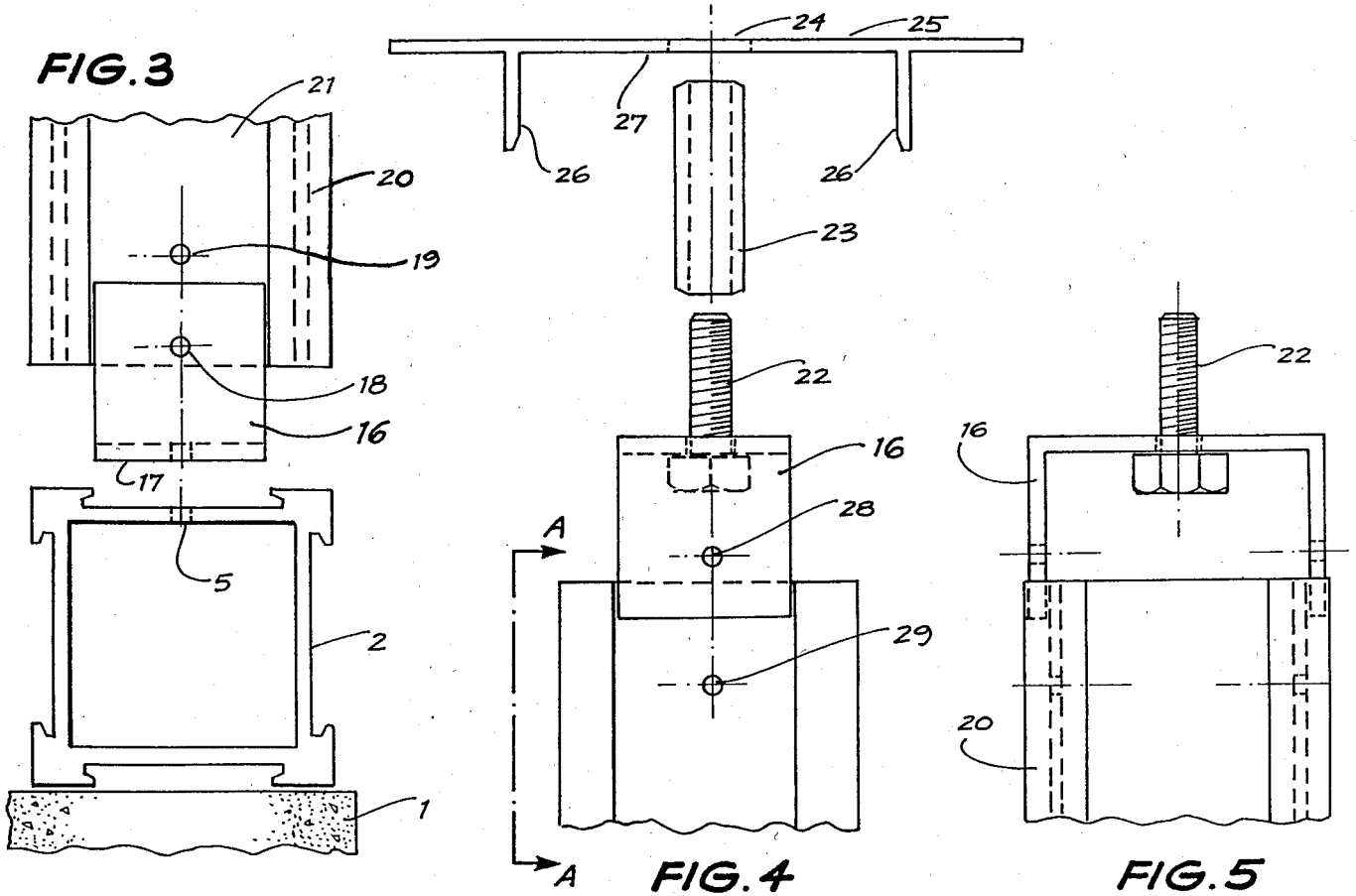
FIG. 3 is a sectional elevation view showing the base member, connecting member and the bottom of an upright.
FIG. 4 is a sectional elevation view showing the channel member, connecting member and the top of an upright.
FIG. 5 is a sectional elevation view in the direction 'A' in FIG. 4.

In FIG. 3 can be seen a preferred method of affixing an upright 20 to base member 2. A "U"-shaped connecting member 16 is preferably pop-rivited or bolted to the base member 2 in the factory, although such fastening can be done on site if required. The connecting members 16 are suitably spaced one from another depending on the size of the panels to be incorporated between uprights.

The bottom face 17 of connector member 16 is adapted to fit flush into slot 8 on the upper face of base member 2, also the side edges of connecting member 16 are adapted to slideably engage the outside face of slot 21 of upright 20. Upright 20 is secured to connecting member 16 preferably by bolting through hole 18 on connecting member 16 and through hole 19 on upright 20, to connect with similar holes or the opposite side (not shown).

FIGS. 4 and 5 show a preferred method of attachment of the uprights 20 to a channel member 25. Connecting members 16 engage slots 21 on the top of upright 20 and are secured preferably by bolting as described above this time through holes 28 and 29 in connecting member 16 and upright 20 respectively.

A bolt 22 is driven through connecting member 16 prior to connecting member 16 being secured to upright 20.

Channel member 25 comprises a series of holes 24 adapted to allow sleeve 23 free passage. The sleeve 23 has internal threads (not shown) to secure, where required, roof members (not shown) preferably by bolting. The slot 27 of channel 25 is to allow the top edges of panel 9 to engage the slot 27 in spigot fashion between side members 26.

Conventional roofing trusses 60 (as illustrated in FIG. 1) can then be secured, by known means, across the channel members 25 and either a metal deck roof or conventional concrete tile roof erected thereon.

An important advantage of the present invention is the resistance to sideways movement given since the uprights and panels are locked in position by means of the channel member and further the panels themselves engage spigot fashion the slots in the base member and uprights.

An additional advantage of the present invention is its versatility to change in design either during construction or as later addition.

This arises because in the present invention the uprights are fully load-bearing and the in-fill panels do not act to support the load of the roof. Thus in-fill panels can be easily removed without affecting the load-bearing capacity of the structure as a whole.

In contrast presently known modular systems rely on the in-fill panel to act in a load-bearing capacity, therefore such panels cannot be easily removed.

Whilst a particular preferred embodiment of the present invention has been described hereinbefore, it will be readily apparent to persons skilled in this art that many modifications and/or variations may be made to the embodiment without departing from the principles of the present invention and that this invention includes all such modifications and variations falling within the spirit and scope thereof.

I claim:

1. A method of modular construction of a house, or other building comprising the steps of:

(a) affixing to a floor or foundation a series of metal base members, said base members having at least a horizontal and a vertical lengthwise extending slot or groove, (b) affixing to said base members a series of metal uprights said uprights having at least one lengthwise extendikng slot or groove on at least two opposing outer faces, a "U" shaped connecting member having a base and two substantially parallel arms extending from said base, said arms slideably engaging said slots on opposing outer faces of said upright and being secured to said upright and said base being secured to said horizontal slot in said base members, (c) attaching panels between said uprights and base member, said panels having a peripheral slot and a gasket seal in said peripheral slot to engage a portion of said base member and said uprights respectively without substantially distorting the seal gasket and thereby form wheather proof joints;

(d) attaching a metal flashing to said vertical slot, (e) affixing to the top of the uprights a series of metal channel members having one lengthwise extending groove, (f) securing a series of roof trusses across the top of said channel members.

2. A method of modular construction of a house or other building comprising the steps of:

(a) horizontally affixing to a floor or foundation along all internal and external wall lines, a series of metal base members said base members having at least a horizontal and a vertical lengthwise extending slot or groove;

(b) affixing to said base members a series of metal uprights said uprights having at least one lengthwise extending slot or groove on at least two opposing outer faces, a "U" shaped connecting member having a base and two substantially parallel arms extending from said base, said arms slideably engaging and being secured to said slots on opposing outer faces of said upright and said base being secured to said horizontal slot in said base members, in a spigot fashion, (c) attaching panels between said uprights and base member, said panels having facings at the underside and vertical sides to partially overlap said uprights and base member, also having a peripheral slot and a gasket seal housed in the peripheral slot to engage the upper outer portion of the said base members without substantially distorting said gasket seal and an exterior portion of the said uprights thereby providing weatherproof joints, said panels being further adapted to engage said base members and said uprights in a spigot fashion, (d) attaching a metal flashing to said vertical slot, (e) affixing to the tops of the uprights and panels a series of metal channel members having one lengthwise extending groove adapted to slideably engage the top of said panels, said metal channel member also having a series of holes to receive metal sleeve members, said sleeve member being affixed to the top of each said upright, (f) securing a series of roof trusses across the top of said channel members.

3. A method as claimed in claim 1 or 2 in which bolts are used to secure the various components either together or to a foundation.

* * * * *

UNITED STATES PATENT AND TRADEMARK OFFICE

CERTIFICATE OF CORRECTION

PATENT NO. : 4,596,100

DATED : June 24, 1986

INVENTOR(S) : Rodney B. Grocott

It is certified that error appears in the above-identified patent and that said Letters Patent is hereby corrected as shown below:

At Column 4, line 21, delete "extendikng" and insert in its place -- extending --

At Column 4, line 34, delete "wheather" and insert in its place -- weather --

Signed and Sealed this

Fourteenth Day of October, 1986

[SEAL]

*Attest:*

DONALD J. QUIGG

*Attesting Officer*

*Commissioner of Patents and Trademarks*